United States Patent [19]

Amano et al.

[11] Patent Number: 4,595,897

[45] Date of Patent: Jun. 17, 1986

[54] SPEED SENSOR DEVICE

[75] Inventors: Hiroyuki Amano, Kariya; Yukihisa Oda, Toyota, both of Japan

[73] Assignee: Aisin Seiki Kabushiki Kaisha, Kariya, Japan

[21] Appl. No.: 570,308

[22] Filed: Jan. 13, 1984

[30] Foreign Application Priority Data

Jan. 13, 1983 [JP] Japan ..... 58-003936

[51] Int. Cl.[4] ..... H01H 9/00

[52] U.S. Cl. ..... 335/205; 324/174; 200/52 R

[58] Field of Search ..... 200/61.22, 61.25, 61.46, 200/61.91, 81.9 M, 84 C, 52 R, 61.39; 335/151, 202, 205–207; 324/168, 174, 207, 208, 235

[56] References Cited

U.S. PATENT DOCUMENTS 1,921,273 8/1933 Wald ..... 200/61.97
3,630,347 12/1971 Davis ..... 200/61.46
4,004,271 1/1977 Haven et al. ..... 200/61.25 X
4,337,652 7/1982 Matsuda et al. ..... 200/61.25 X
4,463,312 7/1984 Oda et al. ..... 324/174

FOREIGN PATENT DOCUMENTS 57-169678 10/1982 Japan .

*Primary Examiner*—J. R. Scott
*Attorney, Agent, or Firm*—Oblon, Fisher, Spivak, McClelland & Maier

[57] ABSTRACT

A magnetic sensing device which includes a reed switch installed in a housing of synthetic resin and electrically connected with an automobile body. The device further includes a metal plate member having a projection fitted into the housing, the reed switch being electrically connected with a control circuit at a first end thereof and which is electrically connected with the metal plate member at a second end thereof, and a mechanism for grounding current from the reed switch to a portion of an automobile body through the metal plate member.

5 Claims, 3 Drawing Figures

SPEED SENSOR DEVICE

BACKGROUND OF THE INVENTION

1. Field of the Invention

This invention relates generally to magnetic sensing devices and more particularly to a magnetic sensing device for detecting vehicle speed wherein the magnetic sensing device is attached to a transmission case of an automobile.

2. Description of the Prior Art

Modern automotive parts including a magnetic sensing are required to be made lighter in view of conservation of resources and fuel. In order to meet this requirement, automobile manufacturers have utilized magnetic sensing devices having a maximum content of synthetic resins. However, in conventional speed used in detecting the rotational magnetic sensing of the output shaft of a transmission and in controlling vehicle speed, a ground is necessary for electrically detecting the rotational speed of the output shaft. Although grounding is accomplished by an electrical connection of the housing of the magnetic sensing device with the vehicle body, there is a disadvantage in that there may occur difficulty in grounding. Also a lack of mechanical strength results by reason that the housing material of the magnetic sensing device constitutes non-conductive synthetic resin. As a result, the housing of conventional magnetic sensing devices is typically made of aluminum and use of such aluminum for the housing correspondingly results in a high cost of manufacturing.

SUMMARY OF THE INVENTION

It is therefore an object of the present invention to avoid the disadvantages of the prior art magnetic sensing devices noted above.

More particularly, it is an object of the present invention to provide an improved magnetic sensing device of the type wherein the housing of the magnetic sensing device is made of synthetic resin.

It is another object of the present invention to provide a magnetic sensing device which is lighter in construction, maintains necessary mechanical strength and, furthermore, has reliability in grounding and is low in cost.

These and other objects are achieved or facilitated in accordance with the present invention by providing a new and improved magnetic sensing device which includes a housing made of synthetic resin, a metal plate member integrally fixed to the housing, a reed switch installed in the housing and having one end thereof electrically connected with a control circuit and the other end thereof electrically connected with the metal plate member through a holder mechanism for the reed switch and a terminal, and grounding means for electrically connecting current from the reed switch to the automobile body through the metal plate member.

Accordingly, it is possible to provide a magnetic sensing device wherein the housing is made not only lighter but also reinforced and grounded by reason of the metal plate member being integrally fixed to the housing. As a result, the objects of the present invention can be obtained.

BRIEF DESCRIPTION OF THE DRAWINGS

Other objects, features and attendant advantages of the present invention will become more appparent from the following detailed description thereof, when considered in connection with the accompanying drawings, wherein like reference characters are used to designate like or corresponding parts throughout the several views and in which.

DETAILED DESCRIPTION OF THE PREFERRED EMBODIMENT

Figure 1:
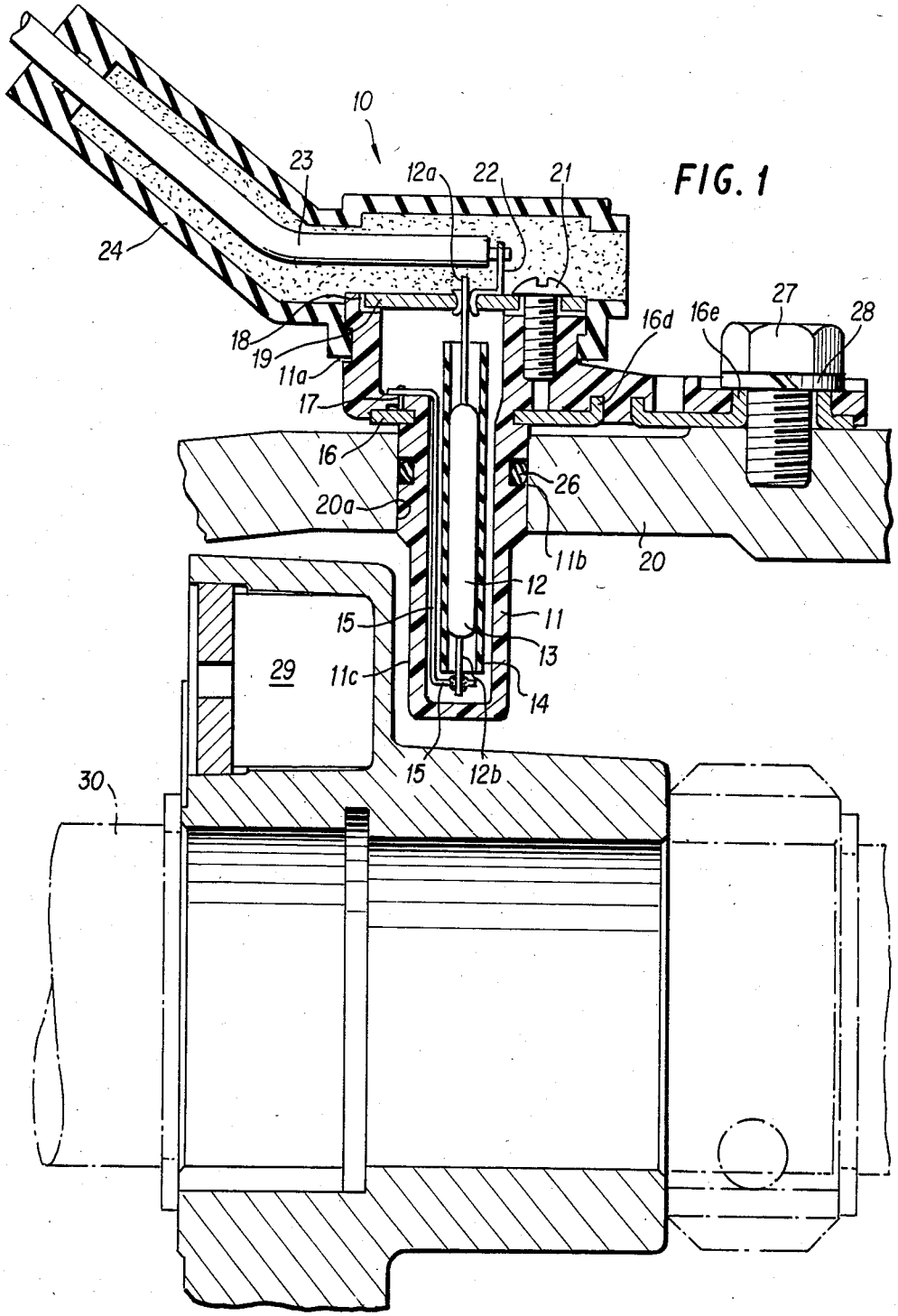
FIG. 1 is a sectional view of a magnetic sensing device constructed in accordance with the present invention.
Figure 2:
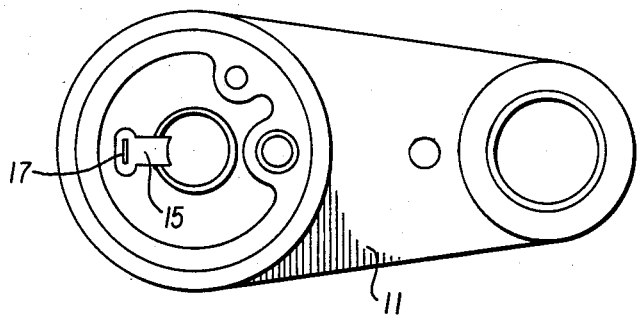
FIG. 2 is a plane view of the housing before assembly as part of the magnetic sensing device of FIG. 1.

Referring now to the drawings and more particularly to FIG. 1 thereof, a magnetic sensing device 10 of the present invention includes a housing 11 formed of synthetic resin. The magnetic sensing device 10 is supported by a metal transmission case 20. A reed switch 12 having a glass pipe 13 is installed in the housing 11. The glass pipe 13 is protected by a tube 14 or cylinder made of rubber or a similar elastomeric material. The lower end **12*b* of reed switch 12 is electrically connected with the lower portion of a holder member 15 by soldering. The upper portion of the holder member 15 is electrically connected by soldering with a terminal 17 fixed to a metal plate member 16** by spot welding.

Figure 3:
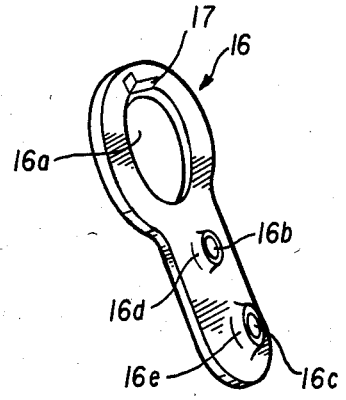
FIG. 3 is a perspective view of the metal plate member which is used in the magnetic sensing device of FIG. 1.

The preferred shape of the metal plate member 16 is shown in FIG. 3. The metal plate member 16 consists of a steel plate having a constant thickness and includes one larger hole **16*a* and two small holes 16*b*, 16*c* formed therein. Circular flange portions 16*d*, 16*e* are formed by pressing of the holes 16*b* and 16*c* at o,e end portion of the metal plate member 16**.

The housing 11 of synthetic resin is molded on the metal plate member 16 and, as a result, is integrally fixed to the metal plate member 16. The engagement between the housing 11 and the metal plate member 16 is reinforced by the circular flange portions **16*d*, 16*e* of metal plate member 16 extending into the housing 11 of synthetic resin. In order to be groundable with certainty, the metal plate member 16 is situated so as to extend radially outwardly from housing 11 and, as a result, the metal plate member 16 is directly electrically engageable with transmission case 20**.

A plate member 19 is fixed to the upper opening portion of housing 11, with a gasket 18 being disposed therebetween via a bolt member 21. An eyelet 22 is fixed to the central portion of the plate 19 by caulking, welding or similar securing means. The upper end **12*a* of reed switch 12 is electrically connected with the eyelet 22 by soldering. One end of lead wire 23 is electrically connected with eyelet 22 by soldering. The other end of lead wire 23** is connected to a control circuit (not shown).

Annular groove **11*a* is formed at the upper peripheral portion of housing 11 for receiving a cap member 24 therein. The cap member 24 is made of rubber and has a cavity formed therein and an epoxy resin is loaded into the cavity of cap member 24** for insulation purposes.

Connection of housing 11 to the transmission case 20 begins with the installation of a sealing ring 26 in the outer peripheral portion **11*b* of housing 11. The outer peripheral portion 11*b* of housing 11 is then installed into a hole 20*a* formed in transmission case 20. Thereafter, the housing 11 is fixed to the transmission case 20 by a bolt member 27 made of metal and a spring washer member 28 made of metal. In such arrangement, attached to an output shaft (not shown) of the transmission and positioned below a lower portion 11***c* of housing 11 is a rotational shaft 30 which includes a permanent magnet 29. The permanent magnet 29 rotates in response to rotation of the output shaft of the transmission. By means of such rotation, the reed switch 12 can be opened and closed in response to changes in the density of the magnetic flux, thereby controlling the electrical contact therein so that the electrical contact may be selectively electrically conductive or nonconductive. More particularly, the electrical contact is conductive when the permanent magnet 29 approaches the reed switch 12, and changes so as to be nonconductive when the permanent magnet 29 shifts away from the reed switch 12. Thus the magnetic sensing device 10 reflects the conditions of electrical conduction and nonconduction in accordance with rotation of the output shaft of the transmission.

Under the condition of electrical conduction, a current, introduced into the upper end 12*a* of reed switch 12 through lead wire 23 and eyelet 22, is conducted to the lower end 12*b* of reed switch 12 and, as a result, is grounded to the transmission case 20 via holder member 15, terminal 17 and the metal plate member 16. Therefore, the number of revolutions of the output shaft of the transmission can be electrically detected, and grounding can be accomplished upon contacting of the bottom surface of metal plate member 16 with the surface of transmission case 20. Furthermore, in order to allow for reliable grounding, metal plate member 16 is electrically connected with the transmission case 20 through circular flange portion 16*e*, spring washer member 28 and the threaded portion of bolt 27.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic sensing device utilizing a control circuit and which is operatively associated with a portion of an automobile body, comprising:

permanent magnet means;

detecting means for detecting a change of magnetic flux of said permanent magnet means applied thereto in response to rotational displacement of said permanent magnet means;

a housing composed of synthetic resin;

a holder member positioned in said housing and formed of an electrically conductive material;

a metal plate member integrally fixed to said housing and having at least one projection extending therefrom into said housing;

a terminal member connected between a first end of said holder member and said metal plate member;

said detecting means having a first end thereof electrically connected with said control circuit and a second end thereof electrically connected with a second end of said holder member; and means for grounding current from said detecting means to said metal portion of said automobile body via said metal plate member.

2. A device according to claim 1, wherein said means for grounding said current further comprises a circular flange portion extending from said metal plate member and a bolt fitted in said circular flange portion of said metal plate member for fixing said metal plate member to said portion of said automobile.

3. A device according to claim 2, wherein said grounding means further comprises a spring washer interposed between said bolt and said circular flange portion.

4. A device according to claim 1, wherein said means for grounding said current further comprises a circular flange portion extending from said metal plate member, a bolt fitted in said circular flange portion of said metal plate member for fixing said metal plate member to said portion of said automobile body and a spring washer interposed between said bolt and said circular flange portion.

5. A device according to claim 1, wherein said portion of said automobile body further comprises a transmission case.

* * * * *